US007333627B2

(12) United States Patent
Ventrola et al.

(10) Patent No.: US 7,333,627 B2
(45) Date of Patent: Feb. 19, 2008

(54) AUXILIARY PLAYPEN SPEAKER

(75) Inventors: Todd Ventrola, Liberty Township, OH (US); Thomas J. Witman, Huber Heights, OH (US)

(73) Assignee: Evenflo Company, Inc., Vandalia, OH (US)

( * ) Notice: Subject to any disclaimer, the term of this patent is extended or adjusted under 35 U.S.C. 154(b) by 579 days.

(21) Appl. No.: 10/872,275

(22) Filed: Jun. 18, 2004

(65) Prior Publication Data

US 2005/0281428 A1 Dec. 22, 2005

(51) Int. Cl.
*H04R 1/00* (2006.01)
*H04R 1/02* (2006.01)

(52) U.S. Cl. ..... 381/388; 381/395

(58) Field of Classification Search ..... 381/345, 381/386, 388, 395, 301, 311, 333, 334, 336; 446/297, 302, 227

See application file for complete search history.

(56) References Cited

U.S. PATENT DOCUMENTS 4,640,034 A 2/1987 Zisholtz
4,670,820 A 6/1987 Eddins et al.
4,967,432 A 11/1990 Kujawski et al.
D396,717 S 8/1998 Sidman et al.
5,803,786 A 9/1998 McCormick
5,833,189 A 11/1998 Rossman et al.
5,951,360 A 9/1999 Fearon et al.
5,991,131 A * 11/1999 Othman ..... 360/137
6,022,262 A 2/2000 Gill
6,113,455 A 9/2000 Whelan et al.
6,203,395 B1 3/2001 McElhaney
6,418,575 B1 7/2002 Cheng
7,049,968 B2 * 5/2006 Fitzgerald et al. ..... 340/539.15
7,110,839 B2 * 9/2006 Wood ..... 381/123
7,154,389 B2 * 12/2006 Marsden et al. ..... 340/539.15
2004/0129749 A1 * 7/2004 Hassett ..... 224/617
2004/0200871 A1 * 10/2004 Han ..... 224/576
2005/0170744 A1 * 8/2005 Smith et al. ..... 446/297

* cited by examiner

*Primary Examiner*—Brian Ensey
(74) *Attorney, Agent, or Firm*—Taft Stettinius & Hollister LLP

(57) ABSTRACT

A portable auxiliary speaker for a playpen or a crib comprising a housing incorporating a loudspeaker, the housing being adapted to receive at least a portion of a framework of a crib or a playpen to mount the housing to the crib or the playpen, wherein the housing includes an input adapted to be operatively coupled to at least one of a radio, a CD player, an MP3 player, a cassette player, a computer, and a DVD player.

14 Claims, 4 Drawing Sheets

AUXILIARY PLAYPEN SPEAKER

BACKGROUND

1. Field of the Invention

The present invention is directed to a portable auxiliary speaker, and more specifically to an auxiliary speaker selectively mounted to a playpen or other structure and adapted to be in communication with a CD, MP3, or cassette player to provide music for a child therein.

2. Background of the Invention

Musical devices operative to broadcast audible sounds are well known in the art. Likewise, it is known in the art to provide devices that are visually and audibly stimulating to younger children. A typical device might include an arch over a crib playing music in conjunction with rotation of objects in the form of an overhead carousel. However, there is a need for a portable and/or fixed device allowing plug-and-play capabilities that is compatible with a majority of wired and/or wireless devices to provide musical enjoyment to children within a room and/or a playpen or crib.

SUMMARY OF THE INVENTION

The present invention is directed to a portable auxiliary speaker that is selectively mounted to a structure such as a crib or a playpen, where the speaker includes an input to receive signals from a music player, thereby translating such signals into audible sound. Exemplary music players are known to those of ordinary skill and include, without limitation, a radio, a CD player, an MP3 player, a cassette player, a computer, and a DVD player.

The speaker may also include a bag selectively coupled thereto that is adapted to hold the music player therein. In an exemplary embodiment, the bag is adapted to hold a portable CD player and the cable connecting the CD player and the speaker. The bag also includes a strap that selectively engages the structure to which the speaker is mounted to order to limit the range of movement of the bag.

DETAILED DESCRIPTION

The exemplary embodiments of the present invention are described and illustrated below to encompass systems and methods for facilitating enjoyment of music by children. Of course, it will be apparent to those of ordinary skill in the art that the preferred embodiment discussed below is exemplary in nature and may be reconfigured without departing from the scope and spirit of the present invention. However, for clarity and precision, the exemplary embodiment includes one or more optional features that one of ordinary skill may recognize as not being a requisite to fall within the scope of the present invention.

Figure 1:
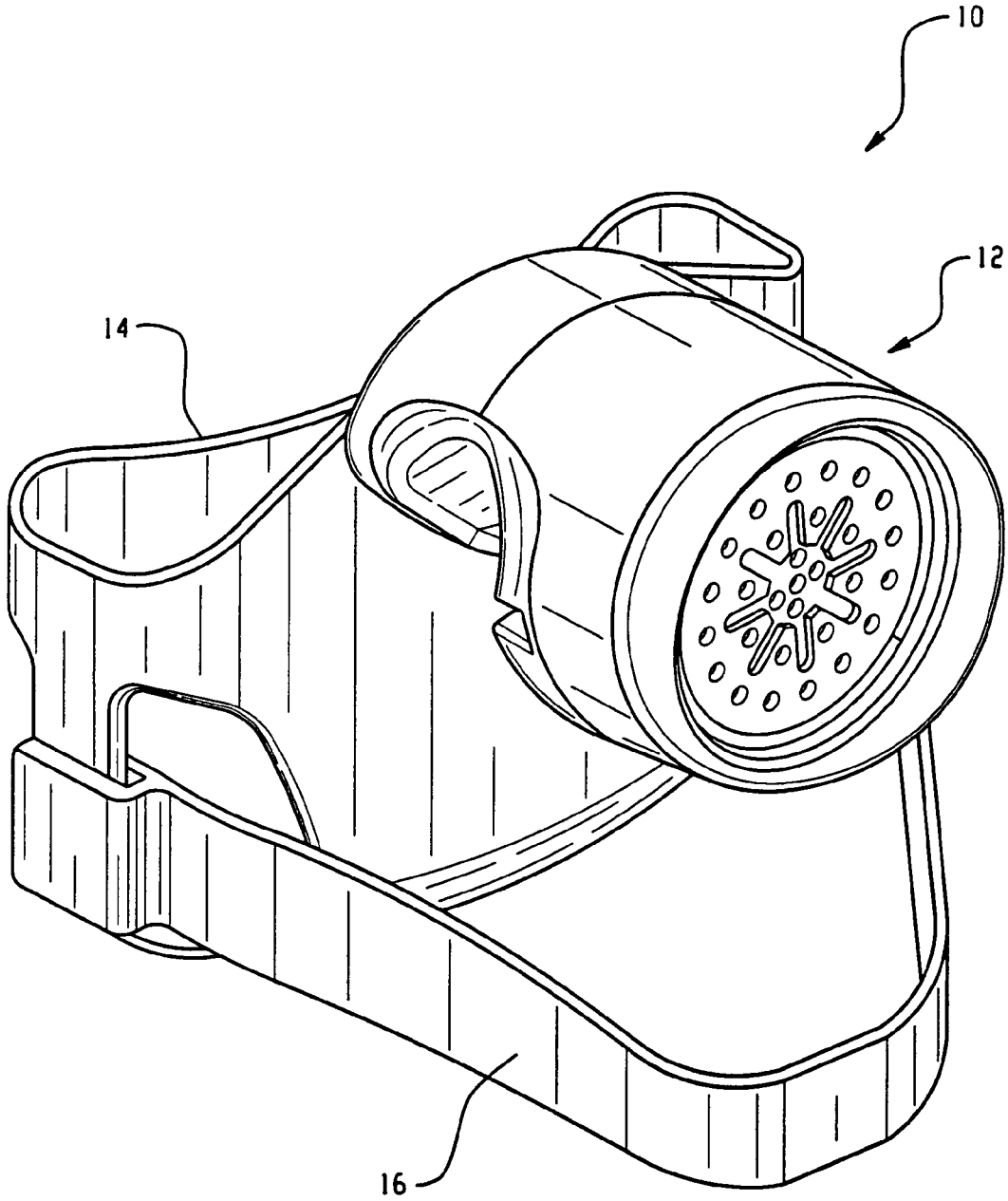
FIG. 1 is an elevated frontal perspective view of an exemplary embodiment of the present invention.
Figure 2:
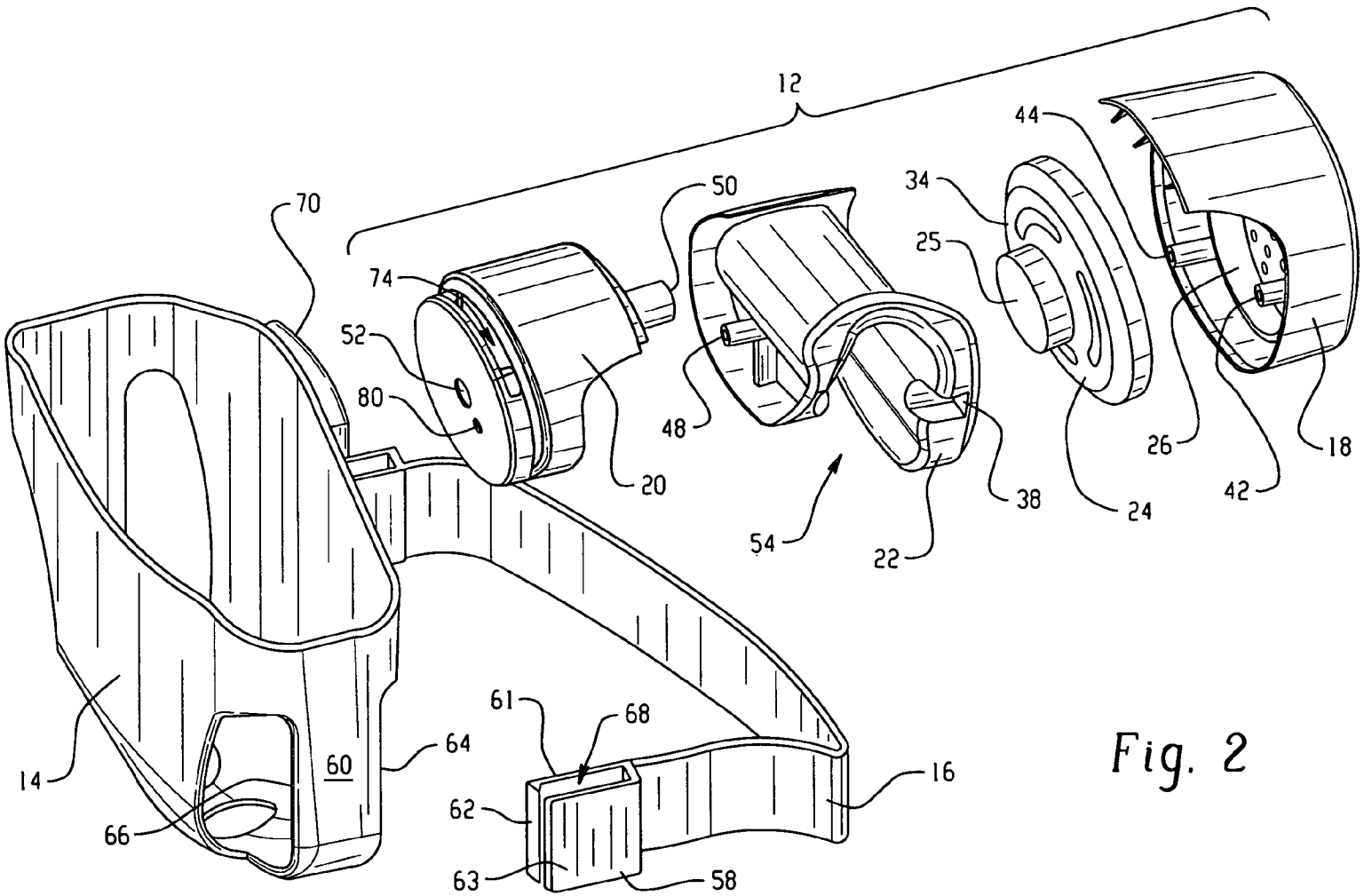
FIG. 2 is an elevated rearward exploded view of the exemplary embodiment of FIG. 1.
Figure 3:
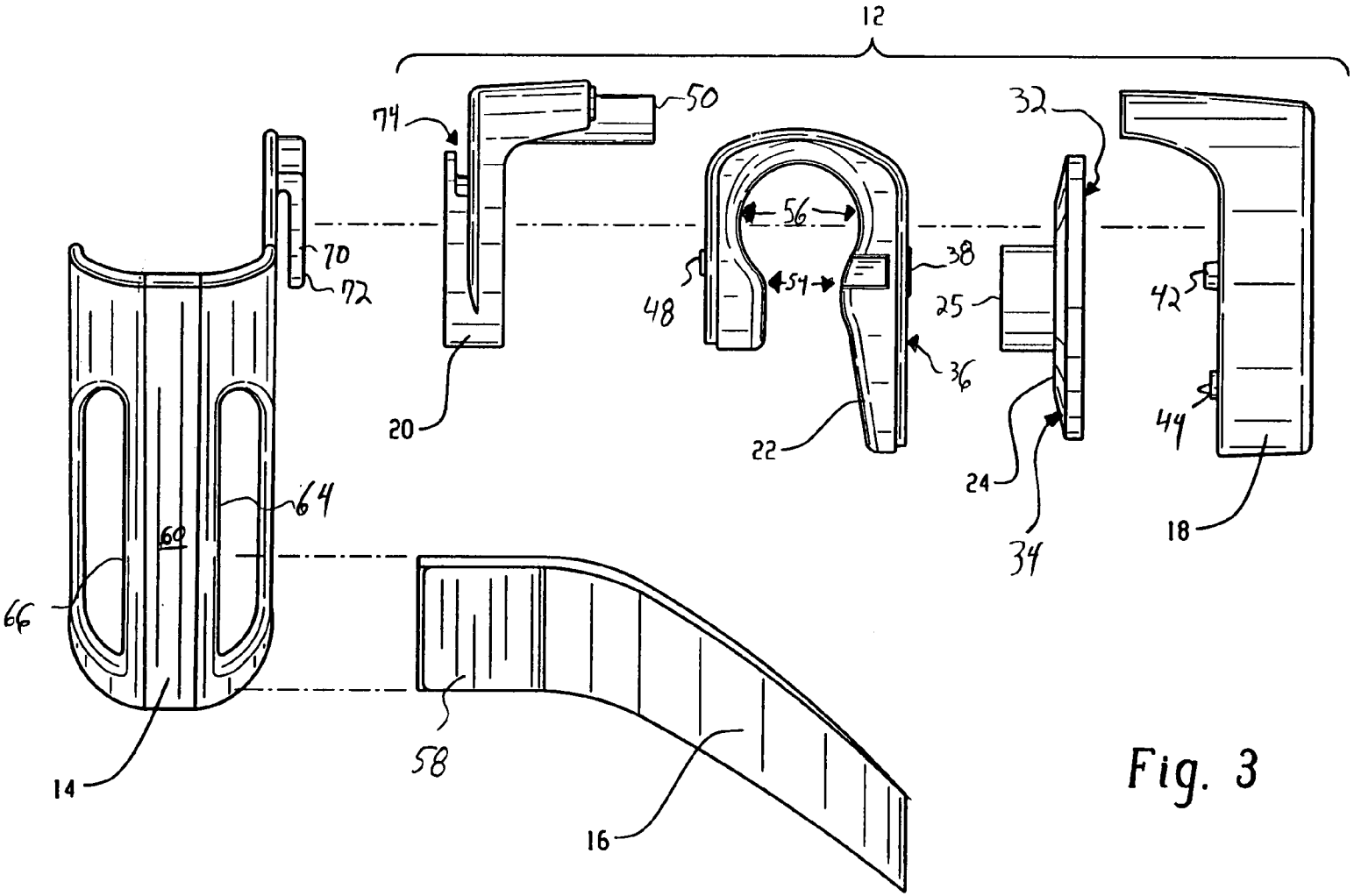
FIG. 3 is an exploded profile view of the exemplary embodiment of FIG. 1.
Figure 4:
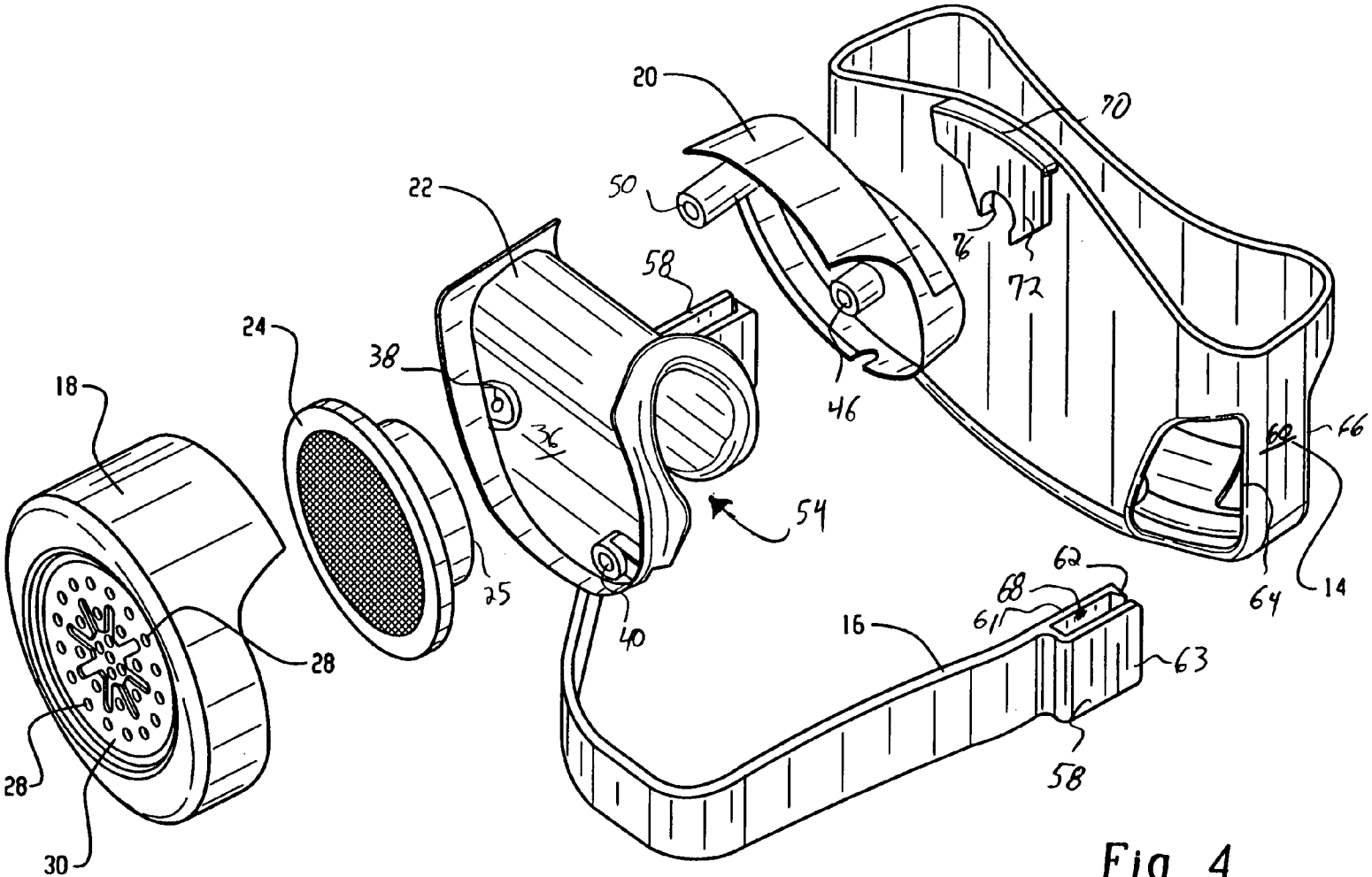
FIG. 4 is an elevated frontal exploded view of the exemplary embodiment of FIG. 1.

Referencing FIGS. 1-4, an exemplary embodiment 10 of the present invention includes an auxiliary speaker 12 coupled to a satchel 14 having a repositionable strap 16.

The auxiliary speaker 12 includes a front cover 18 and a rear housing 20 that sandwich a clamp 22 and a speaker 24 therebetween. The front cover 18 includes a recess 26 having a grill 28 with a plurality of holes 30 therethrough. The recess 26 is adapted to receive a front aspect 32 of the speaker 24 therein. A rearward aspect 34 of the speaker 24, at least partially comprising the magnet 25, is positioned adjacent to a front exterior surface 36 of the clamp 22. Two screws (not shown) are adapted to pierce two corresponding orifices 38, 40 of the clamp 22 and engage two corresponding conduits 42, 44 of the front cover 18 to secure the front cover 18 to the clamp 22 or vice versa. Coupling the front cover 18 to the clamp 22 frictionally secures the speaker 24 therebetween.

The rear housing 20 is also mounted to the clamp 22. A screw (not shown) is adapted to pierce an orifice 46 through the rear housing 20 and engage a corresponding conduit 48 of the clamp 22 to secure the rear housing 20 to the clamp 22 or vice versa. Additionally, the rear housing 20 includes a hollow projection 50 adapted to receive a screw (not shown) therein that is adapted to likewise engage a corresponding conduit (not shown) in the front housing 18 to mount the housings 18, 20 together. The rear housing 20 also includes an input jack 52 therein adapted to receive an audio input (not shown) from a music player such as, without limitation, a radio, a CD player, an MP3 player, a cassette player, a computer, and a DVD player to translate electrical signals from the music player into audible sound. The rear housing 20 further includes an output jack 80 adapted to receive an output conduit (not shown) to convey electrical signals to one or more further speakers (not shown).

The clamp 22 is adapted to be resilient and provide a variable width gap 54 to accommodate an object (not shown) having a predetermined width to secure the clamp thereto. Exemplary objects include, such as, without limitation, a railing of a playpen or a crib. Such exemplary objects are intended to pass beyond the gap 54 and into a channel 56 horizontally traversing the clamp 22. If the object is slightly wider than the width of the gap 54, the pliable nature of the clamp 22 will allow for a slight displacement, thereby increasing the width of the gap 54 and potentially allowing the object to pass thereby and be secured within the channel 56. However, it is also within the scope of the invention that the gap 54 be at least partially occupied by an exemplary object, thereby wedging the object between that gap 54 such that the speaker 12 is sitting upon the object. In such an exemplary orientation, the strap 16 may likewise secure the exemplary embodiment 10 to the exemplary object.

The strap 16 may include two U-shaped ends 58 adapted to receive a strip 60 of the satchel 14 therein to couple the strap 16 thereto. Each end 58 includes at least one finger 61 with a tapered surface 62 that engages a leading edge 64 of the strip 60 and upon contacting the strip biases the finger 61 outward. Once the surface 62 has passed beyond a trailing edge 66 of the strip 60, the bias force provided by the presence of the strip 60 is no longer present and allows the finger 61 to move toward the second finger 63 to secure the strip within a U-shaped cavity 68. The strap 16 may be removed by biasing the fingers 61, 63 apart and introducing the strip 60 therebetween and reversing the process described above, thereby rendering the leading edge of the strip 60 the trailing edge and vice versa.

The satchel 14 may also include a clip 70 to mount the satchel 14 to the speaker 12. The clip 70 includes a projection 72 extending therefrom that is adapted to be received within a cavity 74 on the backside of the rear housing 20.

The projection 72 includes a generally semicircular notch 76 therein adapted to receive a semicircular hump (not shown) within the cavity 74. In sum, the cavity 74 includes corresponding topography to interface with the projection 72 to secure the projection therein. This corresponding interface provides for selective coupling between the satchel 14 and the rear housing 20 to facilitate engagement between the speaker 12 and satchel 14 when in use and likewise facilitate disengagement when not in use.

Exemplary music players may be coupled to the speaker 12 by a cable to provide electrical communication therebetween. However, it is also within the scope of the invention that the speaker incorporate a wireless receiver to receive signals from the music player to provide a cordless feature. Still further, it is also within the scope of the invention to provide an output jack for the speaker 12 to enable parallel connections between auxiliary speakers, thereby providing multiple speakers disseminating sound waves from a single music player without requiring multiple outputs from the music player.

Following from the above description and invention summaries, it should be apparent to those of ordinary skill in the art that, while the apparatus described herein constitutes an exemplary embodiment of the present invention, the invention contained herein is not limited to this precise embodiment and changes may be made to the aforementioned embodiment without departing from the scope of the invention as defined by the claims. Additionally, it is to be understood that the invention is defined by the claims and it is not intended that any limitations or elements describing the exemplary embodiment set forth herein are to be incorporated into the interpretation of any claim element unless such limitation or element is explicitly stated. Likewise, it is to be understood that it is not necessary to meet any or all of the identified advantages or objects of the invention disclosed herein in order to fall within the scope of any one of the claims, since the invention is defined by the claims and since inherent and/or unforeseen advantages of the present invention may exist even though they may not have been explicitly discussed herein.

What is claimed is:

1. A portable auxiliary speaker for a playpen or a crib comprising a housing incorporating a loudspeaker, the housing being adapted to receive at least a portion of a framework of a crib or a playpen to mount the housing to the crib or the playpen, and a pouch removably mounted to the housing and adapted to receive a portable electronic device, wherein the housing includes an input adapted to be operatively coupled to the portable electronic device, wherein the portable electronic device includes at least one of a radio, a CD player, an MP3 player, a cassette player, a computer, and a DVD player, and wherein the housing is repositionable with respect to the portable electronic device.

2. The auxiliary speaker of claim 1, wherein at least one of the radio, the CD player, the MP3 player, the cassette player, the computer, and the DVD player provides a source of power to the loudspeaker.

3. The auxiliary speaker of claim 1, wherein the housing is slidably repositionable along a length of the framework of the crib or the playpen.

4. The auxiliary speaker of claim 1, wherein the housing includes a fastener adapted to receive at least a portion of the framework of the crib or the playpen.

5. The auxiliary speaker of claim 4, wherein the fastener includes a tapered opening having a variable width opening adapted to receive differing width portions of the framework.

6. The auxiliary speaker of claim 1, wherein the pouch includes a strap adapted to limit a range of movement of the pouch relative to the framework of the crib or the playpen.

7. An auxiliary speaker system adapted to be repositionable with respect to a children's playpen or crib and disseminate audible waves for musical enjoyment of a child, the speaker system comprising:

a housing including a sound wave propagation unit adapted to receive signals from a portable electronic device; and a pouch adapted to receive the portable electronic device therein;

wherein the housing includes a mount adapted to mount the housing and vouch to a crib or a playpen; and wherein the pouch is selectively mounted to the housing such that, upon mounting the housing to the crib or the playpen, the pouch is positioned outside of the crib or the playpen.

8. The auxiliary speaker system of claim 7, wherein the portable electronic device is at least one of a CD player, an MP3 player, a cassette player, a computer, and a DVD player.

9. The auxiliary speaker system of claim 7, wherein the housing includes an output jack.

10. The auxiliary speaker system of claim 7, wherein the mount includes a clamp.

11. An auxiliary sneaker system adapted to be repositionable with respect to a children's playpen or crib and disseminate audible waves for musical enjoyment of a child, the speaker system comprising:

a housing including a sound wave propagation unit adapted to receive signals from a portable electronic device; and a pouch adapted to receive the portable electronic device therein;

wherein at least one of the housing and the pouch include a mount adapted to mount the housing and pouch to a crib or a playpen; and wherein the housing include an hourglass opening therein, where at least a portion of the hourglass opening is adapted to receive a frame member of the crib or playpen to mount the housing thereto.

12. The auxiliary speaker system of claim 7, wherein the sound wave propagation unit includes a wireless receiver to receive the signals from the portable electronic device.

13. The auxiliary speaker system of claim 7, wherein no dimension of the housing exceeds seven inches.

14. The auxiliary speaker system of claim 7, wherein the portable electronic device is independent from the housing.

* * * * *